US006886823B2

(12) United States Patent
Herbert

(10) Patent No.: US 6,886,823 B2
(45) Date of Patent: May 3, 2005

(54) PRINTING MACHINE WITH SEVERAL SECTIONS

(75) Inventor: Burkard Otto Herbert, Würzburg (DE)

(73) Assignee: Koenig & Bauer Aktiengesellschaft, Wurzburg (DE)

( * ) Notice: Subject to any disclaimer, the term of this patent is extended or adjusted under 35 U.S.C. 154(b) by 0 days.

(21) Appl. No.: 10/481,409

(22) PCT Filed: Jun. 6, 2002

(86) PCT No.: PCT/DE02/02055

§ 371 (c)(1),
(2), (4) Date: Dec. 30, 2003

(87) PCT Pub. No.: WO03/004272

PCT Pub. Date: Jan. 16, 2003

(65) Prior Publication Data

US 2004/0144271 A1 Jul. 29, 2004

(30) Foreign Application Priority Data

Jul. 2, 2001 (DE) ..... 101 31 976

(51) Int. Cl.[7] ..... B41F 13/56; B41F 13/54; B41F 13/58

(52) U.S. Cl. ..... 270/20.1; 101/227; 493/356

(58) Field of Search ..... 101/117, 138, 101/178, 219, 224–228; 270/4, 6, 5.01, 20.1, 21.1, 41–43, 17–18; 493/356–359

(56) References Cited

U.S. PATENT DOCUMENTS

| | | | | |
|---|---|---|---|---|
| 3,942,782 A | | 3/1976 | Hermach | |
| 5,279,410 A | * | 1/1994 | Arashima et al. | 206/723 |
| 5,328,437 A | | 7/1994 | Maylander et al. | |
| 5,415,093 A | | 5/1995 | Numauchi | |
| 5,421,567 A | * | 6/1995 | Bolza-Schunemann | 270/9 |
| 5,436,844 A | * | 7/1995 | Tokiwa | 700/122 |
| 5,503,379 A | * | 4/1996 | Michalik et al. | 270/5.01 |
| 5,676,056 A | | 10/1997 | Stein et al. | |
| 5,707,054 A | * | 1/1998 | Loquet et al. | 270/6 |
| 5,775,222 A | * | 7/1998 | Zweifel et al. | 101/227 |
| 6,082,259 A | | 7/2000 | Siegenthaler et al. | |
| 6,408,748 B1 | * | 6/2002 | Hajek et al. | 101/177 |
| 6,513,427 B2 | | 2/2003 | Pautrat | |
| 6,588,739 B1 | * | 7/2003 | Weis | 270/6 |
| 2002/0097407 A1 | * | 7/2002 | Ryan et al. | 358/1.1 |

FOREIGN PATENT DOCUMENTS

| | | |
|---|---|---|
| DE | 198806 | 5/1907 |
| DE | 246557 | 1/1910 |
| DE | 393250 | 3/1924 |
| DE | 25 10 057 | 9/1975 |
| DE | 42 04 254 A1 | 8/1993 |
| DE | 195 16 445 A1 | 11/1996 |
| DE | 197 28 207 A1 | 1/1999 |
| DE | 199 58 089 A1 | 6/2001 |
| DE | 199 59 152 A1 | 6/2001 |
| EP | 0 627 312 A2 | 4/1994 |

* cited by examiner

*Primary Examiner*—Eugene H. Eickholt
(74) *Attorney, Agent, or Firm*—Jones, Tullar & Cooper PC

(57) ABSTRACT

A printing machine includes several sections, each of which has at least one printing unit with at least one web running through the at least one printing unit per section. Two such sections are arranged offset to each other, transverse to the longitudinal direction of the printing machine. Production of a printed product is achieved, at least in part, by using a common folding unit that extends over the total width of the printing machine.

40 Claims, 5 Drawing Sheets

PRINTING MACHINE WITH SEVERAL SECTIONS

FIELD OF THE INVENTION

The present invention is directed to a printing press with several sections. Each of these several sections has at least one printing unit through which at least one web passes.

BACKGROUND OF THE INVENTION

A printing press is known from DE 197 28 207 A1. Webs from two sections, which are in alignment with each other are conducted into two turning towers arranged between them. The webs undergo a change of direction and are possibly laterally offset.

DE 42 04 254 A1 discloses a folding structure with formers which can be displaced transversely in relation to the running direction of the webs. This allows the longitudinal folding of partial webs which, because of having been cut longitudinally, can have changing widths. This also allows the longitudinal folding of paper webs of different total widths.

Two printing presses, which are arranged parallel with each other and which each have an assigned folding structure, are known from EP 0 627 312 A2. In one mode of operation, the imprinted webs can be combined and conducted to one of the two side-by-side folding structures.

The employment of a folding structure with three formers arranged side-by-side and with two formers arranged on top of each other is known from U.S. Pat. No. 3,942,782. The webs to be folded arrive from two sections arranged aligned with each other, each of triple width, and enter the common triple width folding structure.

DE 199 58 089 A1 discloses two printing presses which, for space savings, are arranged horizontally and vertically side-by-side. In one embodiment, a common folding apparatus can be as signed to the two printing presses.

DE 195 16 445 A1 discloses a printing press with two sections which are offset in the longitudinal direction in relation to each other. A common folding structure is arranged only between the sections which extend parallel with each other.

SUMMARY OF THE INVENTION

The present invention is directed to the object of providing a printing press with several sections.

This object is attained in accordance with the invention by providing a printing press with several sections, each of which has at least one printing unit through which at least one web travels. The printing units of at least two sections print on webs which are directed to a folding structure which is common to both sections. The at least two sections using the common folding structure may be arranged transversely offset to a longitudinal direction of the printing press. The folding structure may have a width which corresponds at least to an effective total width of the sections which are arranged offset.

The advantages to be achieved by the present invention lie, in particular, in the high degree of dependability and efficiency in the passage of the web through the printing press, along with simultaneously a great flexibility of products which can be made.

To accomplish a dependable and efficient web guidance, it is particularly advantageous if as many webs as possible run straight, i.e. without turning or lateral offset, through the printing press into the associated former.

In a solution in accordance with a first preferred embodiment of the present invention, several offset, narrower, for example single-width printing units or sections are used instead of one wide one. It is, for example, possible to achieve the productivity of a double-width printing press and to also achieve a high degree of flexibility regarding the usability of different formats of imprinted materials, for example paper formats, without an elaborate, and disadvantageous for the running of the imprinted material, offset of the web or an offset of the formes because of a change from one imprinted material format to another imprinted material format being required. A possibly increased investment outlay is to be considered in contrast to a reduced outlay for retooling and to a reduced danger potential, in case of a web break, and/or to losses in quality.

In connection with a multi-web operation of the several sections, the embodiment of the folding structure, with balloon formers and with variable strand guidance to the folding unit, is of particular advantage in the context of product variety. If the strands can be combined on two folding apparatus, the variety of the products which can be made is further increased.

The offset arrangement of two double-width sections in accordance with a second preferred embodiment of the present invention makes possible the productivity of two double-width sections arranged in alignment, simultaneously with a high product variety. In contrast to double-width sections which are arranged in alignment, it is not necessary, in accordance with the present invention, to guide a complete strand of webs laterally out of the profile of the printing press. If it is intended to produce books or strands of more or less the same thickness, most of the partial webs can be conducted straight ahead and can be centered toward the former while, for example, only a few partial webs, for example two partial webs per section, must be turned out of the center strand onto one of the outer strands.

A high degree of flexibility with respect to product variety, a high printing output, i.e. high productivity, with simultaneously a high dependability in the conveying course of the webs, are achieved by the offset of the several sections of the printing machine, in accordance with the present invention.

BRIEF DESCRIPTION OF THE DRAWINGS

Preferred embodiments of the present invention are represented in the drawings and will be described in greater detail in what follows.

Shown are in.

DESCRIPTION OF THE PREFERRED EMBODIMENTS

Figure 1:
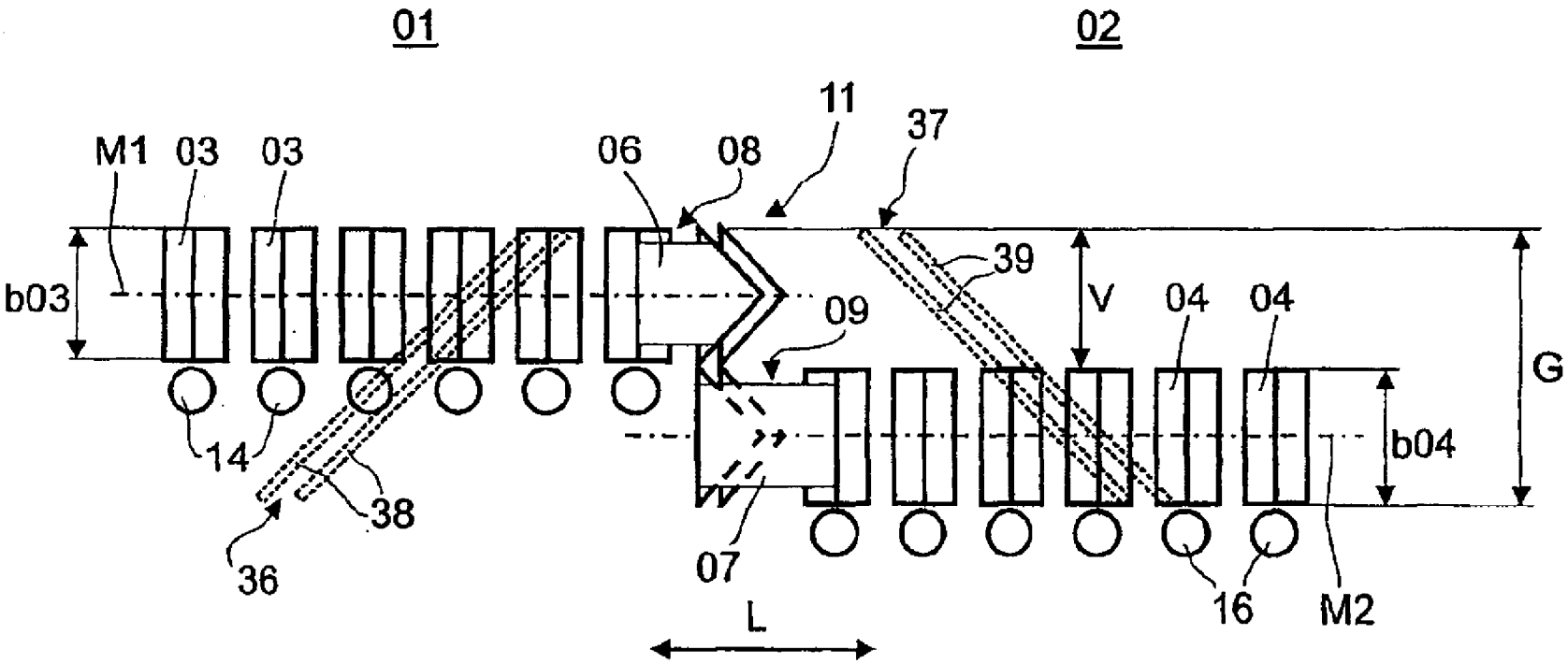
FIG. 1, a schematic representation in a top plan view of a first preferred embodiment of a printing machine with several sections in accordance with the present invention, in FIG. 2, a schematic representation of a web entering a folding structure, in FIG. 3, a first preferred embodiment of a folding structure and a folding unit in accordance with the first preferred embodiment of the present invention, as shown in FIG. 1, in FIG. 4, a second preferred embodiment of a folding structure and a folding unit in accordance with the first preferred embodiment of the present invention, as shown in FIG. 1, and in FIG. 5, a schematic representation in a top plan view of a second preferred embodiment of a printing machine with several sections in accordance with the present invention.

A printing press, and in particular a web-fed rotary printing press, has at least two press sections 01, 02, each with at least one printing unit 03, 04, respectively, through which pass webs 06, 07, all as seen in FIG. 1. For the sake of clarity, only one web 06, 07 for each press section 01, 02 is represented. These webs 06, 07 may be, for example, webs of material 06, 07 to be imprinted.

Each of the printing units 03, 04 of each section 01, 02 is arranged aligned side-by-side and can be arranged on top of each other and/or behind each other. In the preferred embodiments represented in FIG. 1 and in FIG. 5, the printing units 03, 04 of each section 01, 02 are aligned horizontally behind each other, so that center vertical lines of the printing units 03, 04 of the respective sections 01, 02 are each located in one plane M1, M2, respectively.

The sections 01, 02 are positioned, with respect to each other, in such a way that their respective planes M1, M2 do not coincide. In an advantageous embodiment, the sections 01, 02 are arranged in such a way that their respective planes M1, M2 extend parallel to each other, but are each situated transversely with respect to the longitudinal direction L of the printing press, so that they are each offset from each other in an axial direction of the printing group cylinders. For example, in the two embodiments depicted in FIGS. 1 and 5, the printing units 03, 04 are all arranged on the same horizontal plane, for example in one-level construction. The printing units 03, 04 can be bridge printing units, singly or stacked, H-printing units, singly or stacked, so-called towers of eight, individual or stacked nine- or ten-cylinder satellite printing units.

A folding structure 11 is assigned to the two sections 01, 02, as seen in FIG. 1 and is arranged on at least one end 08, 09, in the longitudinal direction, of each section 01, 02, which folding structure 11 extends over at least a total width G of the sections 01, 02, which are arranged offset or side-by-side. In this embodiment depicted in FIG. 1 in particular, an effective total width G of the sections 01, 02 is to be understood as the total width G, which is defined by each of the exteriorly located edges of effective printing unit widths b03, b04 usable for printing of the printing units 03, 04, or their printing group cylinders. The folding structure 11 has at least two formers 12, 13, of which at least one of which is arranged aligned with each of the plane M1 and M2, so that at least one of the formers 12, 13 is centered with respect to the sections 01, 02, or the printing units 03, 04.

Figure 2:
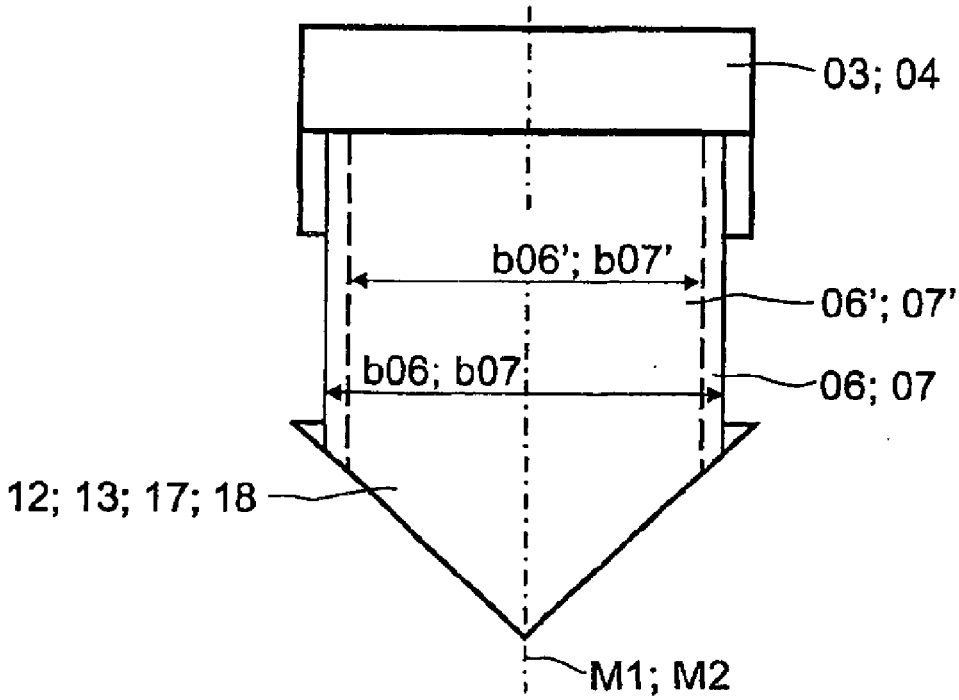

As FIG. 2 schematically shows, is is thus possible to operate the printing press with different web widths, for example with first webs 06, 07 of a first web width b06, b07, or with second webs 06', 07' of a second width b06', b07'. Each of the centers of the webs 06, 07, 06', 07' coincides with the respective plane M1, M2, and each web runs centered to the assigned former 12, 13, independent of the width b06, b07, b06', b07' of the webs 06, 07, 06', or and without a requirement of a lateral offset, or turning of the web.

In the first preferred embodiment, in accordance with FIG. 1, each section 01, 02 has six printing units 03, 04 arranged one behind the other. The two sections 01, 02 are offset with respect to their planes M1, M2. In relation to a longitudinal direction L of the printing press, they are arranged either downstream of, or upstream of the folding structure 11.

In the depicted first embodiment, a lateral offset V of the two sections 01, 02 has at least an effective width b03, b04 of the printing units 03, 04, which effective width b03, b04 is determined by the imprintable width of printing groups, which are not specifically represented in detail, or an effective width of their printing group cylinders, and which effective width simultaneously corresponds to a maximum width b06, b07 of the web 06, 07. If the printing units 03, 04 of the sections 01, 02 have different effective widths b03, b04, or different maximal widths b06, b07, the offset V should be selected to be at least as large as half the sum of b03 and b04, or b06 and b07.

Figure 3:
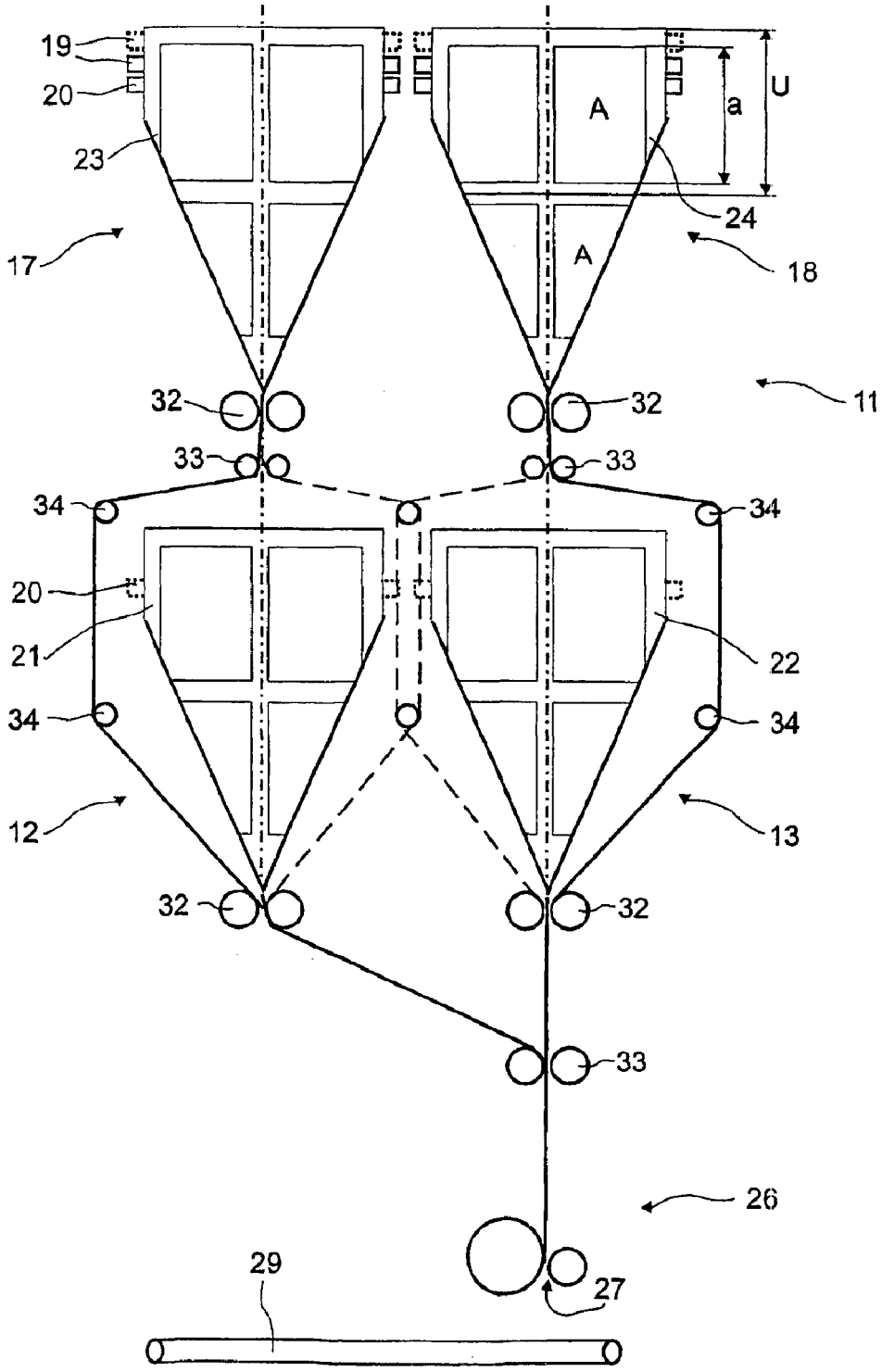
Figure 4:
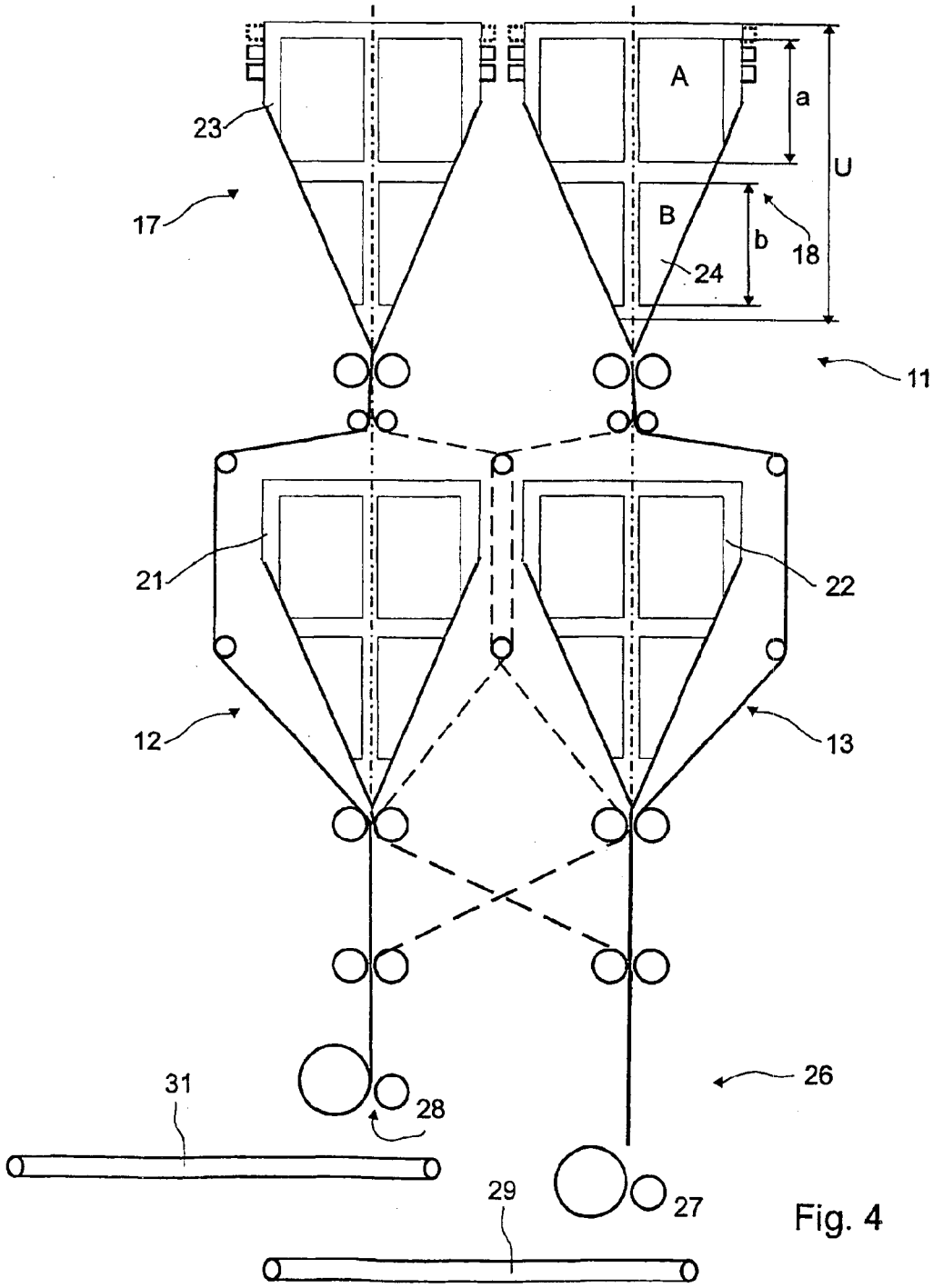

If a product, for example a newspaper, is only longitudinally folded once prior to its delivery, the offset V of the two sections 01, 02 is preferably at least twice the product width, or at least the width of two printed pages A, B, in the axial direction of the printing group cylinders, as shown in FIGS. 3 and 4.

In an advantageous embodiment, the printing units 03, 04 are each embodied with single width printing group cylinders, i.e. with two printed image widths of printed pages A, such as for example newspaper pages A, as seen in FIG. 3, in the longitudinal direction of the printing group cylinder. For manufacturing a product which is to be longitudinally folded prior to entering the folding structure 11, no longitudinal cut is thus required. This, in turn, makes possible the previously discussed use of webs 06, 07, 06', 07' of different widths, each web being oriented centered with respect to the plane M1, M2, shown in FIG. 2, without having to offset the otherwise cut partial webs, or the formers 12, 13. In this case, the folding structure 11 is embodied to be "double wide". It has a width which at least corresponds to a total of four printed pages of the two webs 06, 07 running in next to each other out of the sections 01, 02. In this way, it is possible, without any great outlay, and without making the running of the web 06, 07, more complex, to change between different product formats, for example between different newspaper formats such as the Rheinische, Berlin, New York Times newspaper formats, etc., i.e. by using different rolls 14, 16, for example different rolls 14, 16 of material to be imprinted, for the web 06, 07.

In this first preferred embodiment at least six rolls 14, or 16, respectively are assigned to the six printing units 03, 04 of each section 01, 02, from which the webs 06, 07 are unrolled and are conducted through the printing press. The rolls 14, 16 can be arranged on the same plane as the printing units 03, 04 or can be arranged on a plane different from the printing units 03, 04, for example on a plane which is located underneath the units 03, 04. In FIG. 1 this plane is depicted symbolically next to the printing units 03, 04.

The webs of material 06 from the rolls of material 14 of the first press section 01, and conducted through the printing units 03, can now be conducted during production, the same as the webs of material 07 conducted from the rolls of material 16 of the second press section 02, via rollers, which are not specifically represented, with a straight run of the web "straight", or "straight ahead" to the respectively assigned former 12 or 13 of the folding structure 11. With a symmetrical arrangement of the webs 06, 07, this conveyance of the webs is independent of the width b06, b07 of the webs 06, 07, provided that the effective width b03, b04 of the printing units 03, 04 is not exceeded.

With an increased number of possible webs 06, 07, such as is the case in the present preferred embodiment with six printing units 03, 04 each, an embodiment of the folding structure 11 is advantageous, wherein a further former 17, 18, a so-called balloon former 17, 18, is assigned to each one of the formers 12, 13, which are arranged side-by-side. In a preferred embodiment, the folding structure 11 has two formers 12, 13; 17, 18 each arranged side-by-side, and two formers 12, 17; 13, 18 each arranged on top of each other, as seen in FIG. 3.

The straight course of travel of as many unturned webs 06, 07, as well as a distribution as evenly as possible of the total of twelve webs 06, 07 on four formers 12, 13, 17, 18, for example, is advantageous, in particular in view of dependable and interruption-free web running.

The webs 06, 07 are combined upstream of, or above the formers 12, 13, 17, 18, for example through the use of wire-rod rollers 19 and former draw-in rollers 20, as seen in FIG. 3, into strands 21, 22, 23, 24, and are longitudinally folded by operation of the formers 12, 13, 17, 18 before they are conducted to a folding unit 26 with one or several folding apparatus 27, 28, where they are transversely cut there and, if required, are then folded again once or several times, and leave the printing press in the form of a product or an intermediate product, over one or several delivery devices 29, 31.

Depending on the number and the capabilities of the associated folding apparatus 27, 28, depending on the strand guidance in the folding structure 11, and depending on the number of delivery devices 29, 31 in the folding unit 26, the strands 21, 22, 23, 24 can be processed into a multitude of different products or intermediate products.

In a first preferred embodiment of a folding unit, shown in FIG. 3 of the first preferred embodiment of the printing machine, shown in FIG. 1 of the folding structure 11 and the folding unit 26, the folding structure 11 has the wire-rod rollers 19 and the four formers 12, 13, 17, 18, and the folding unit 26 utilizes a single folding apparatus 27, which is depicted, and which deposits products on a single delivery device 29.

To arrange the strands 21, 22, 23, 24 in the sequence required for the product, the folding structure 11 has, inter alia, known folding rollers 32, traction rollers 33, as well as deflection rollers 34.

In an ideal case of the web run, namely in the case of webs 06, 07 which only run straight, and with an even distribution of the twelve webs 06, 07 to the strands 21, 22, 23, 24, or to the formers 12, 13, 17, 18, each strand 21, 22, 23, 24 has three webs 06 or 07. If the printing units 03, 04, as represented by way of example in FIG. 3 by the emerging printed image, are each equipped with printing group cylinders of single circumference, i.e. with a section length "a" of a printed page A, such as a newspaper page A, at the circumference U, and with single width, i.e. with two printed pages A on a web 06, 07, or on a former 12, 13, 17, 18 side-by-side, a product with four books; each of twelve pages, can be produced by use of the printing press and the folding apparatus 27. However, it is also possible, by use of the straight-running webs 06, 07, to produce books of different numbers of pages. The webs 06, 07 can be combined into strands 21, 22, 23, 24 of different thickness in the formers 12, 17, 13, 18 respectively arranged on top of each other.

When designing the printing units with cylinders of a double circumference U, such as is represented, by way of example, by the emerging printed image in a second embodiment shown in FIG. 4, it is possible, under the above mentioned conditions of straight run, even distribution, and single width to provide a product with maximally eight books, each with maximally twelve pages. This can be accomplished if two section lengths "a", "b" of two printed pages A, B, such as, for example, two newspaper pages A, B, are arranged on the printing group cylinders of double circumference U one behind the other in the circumferential direction, and the folding apparatus is configured for collection operation.

FIG. 4 shows a second embodiment of a folding unit of the first preferred embodiment shown in FIG. 1, of a folding structure 11 with a folding unit 26 wherein, in contrast to the first folding unit shown in FIG. 3, the folding unit 26 has two folding apparatus 27, 28 and two delivery devices 29, 31. This makes possible the production option shown in FIG. 3 in that the strands 21, 22, 23, 24 may be all brought together on one or the other of the two folding apparatus 27, 28, and in this way a single product with a large number of pages can be made.

In addition, however, it is also possible, by use of the folding structure 11 of FIG. 4, to create two different products with the same or with different numbers of books and/or pages by distributing the strands 21, 22, 23, 24 on the two folding apparatus 27, 28 and to deposit them on the two delivery devices 29, 31. To achieve double the production speed, it is also possible to print the same product simultaneously, for example in section 1 and section 2, and to finish them parallel in the folding structure 11, as well as in the folding unit 26, and to deposit them using the folding apparatuses 27, 28.

To further increase flexibility, a turning deck 36, 37, with at least one pair of turning bars 38, 39 extending over the entire width G of the printing press, as shown in and with non-represented devices for length compensation, if required, is arranged in at least one of the sections 01, 02 in a further advantageous development of the present invention.

The basic orientation of the printing press of the present invention already provides for an even distribution, without turning and without lateral offset. By turning only one web 06, 07, it is possible for the printing units 03, 04 of single circumference, or of double circumference with double production, to increase one book by four pages and to reduce the other one of the books by four pages. Doubling of this applies for printing units 03, 04 of double circumference with collection production.

In order to further increase the options in the composition of books, it can be advantageous to provide devices, which are not specifically represented, for accomplishing a longitudinal cutting of the webs 06, 07 upstream of the formers 12, 17, 13, 18. In this way, the books can be put together in steps of two pages, using single circumference, or double production or in steps of four pages, using double circumference and collection production.

If it is intended to achieve greater flexibility in the graduation of the possible number of pages of the product, or in the setup of the books, without a need for equipping them twice with the same printing plates, and for collection, the embodiment of the printing units 03, 04, or of their printing group cylinders, and in particular of the forme cylinders, with a single circumference U, as described above, is of advantage. When changing from one roll 14, 16 of full width b06, b07 (1/1), for example, of the web 06, 07 to a half (½) web 06, 07, etc., a graduation in two lateral steps, so-called "two page jump, is possible.

If the emphasis lies in the option for the simultaneous production of as many varied products as possible, printing units 03, 04 of double circumference, the arrangement of two folding apparatus 27, 28, possibly with sorters and four delivery devices 29, 31, is of advantage.

The numbers discussed in connection with the first preferred embodiment of the invention apply, by way of examples for double-sided multi-color printing, for example by use of printing units 03, 04 which are embodied as towers of eight for four-color printing. If no such demand is made for multi-coloring, it is, for example, also possible, in connection with a section 01, 02 with six webs 06, 07, to pass the web through only four printing units 03, 04, which are configured as printing towers 03, 04. In the same way, it is also possible to embody one section 01, 02 for fewer or more webs 06, 07, in which case, the number of printing units 03, 04, or of printing towers 03, 04, for each section 01, 02, depends on the requirement for colors and the number of webs 06, 07.

Divergent from the first preferred embodiment represented in FIG. 1, it is also possible, for example in connection with appropriate space conditions, to arrange the sections 01, 02 side-by-side. In this case, the webs 06, 07 run from the same side into the common folding structure 11 extending over the entire width G.

Figure 5:
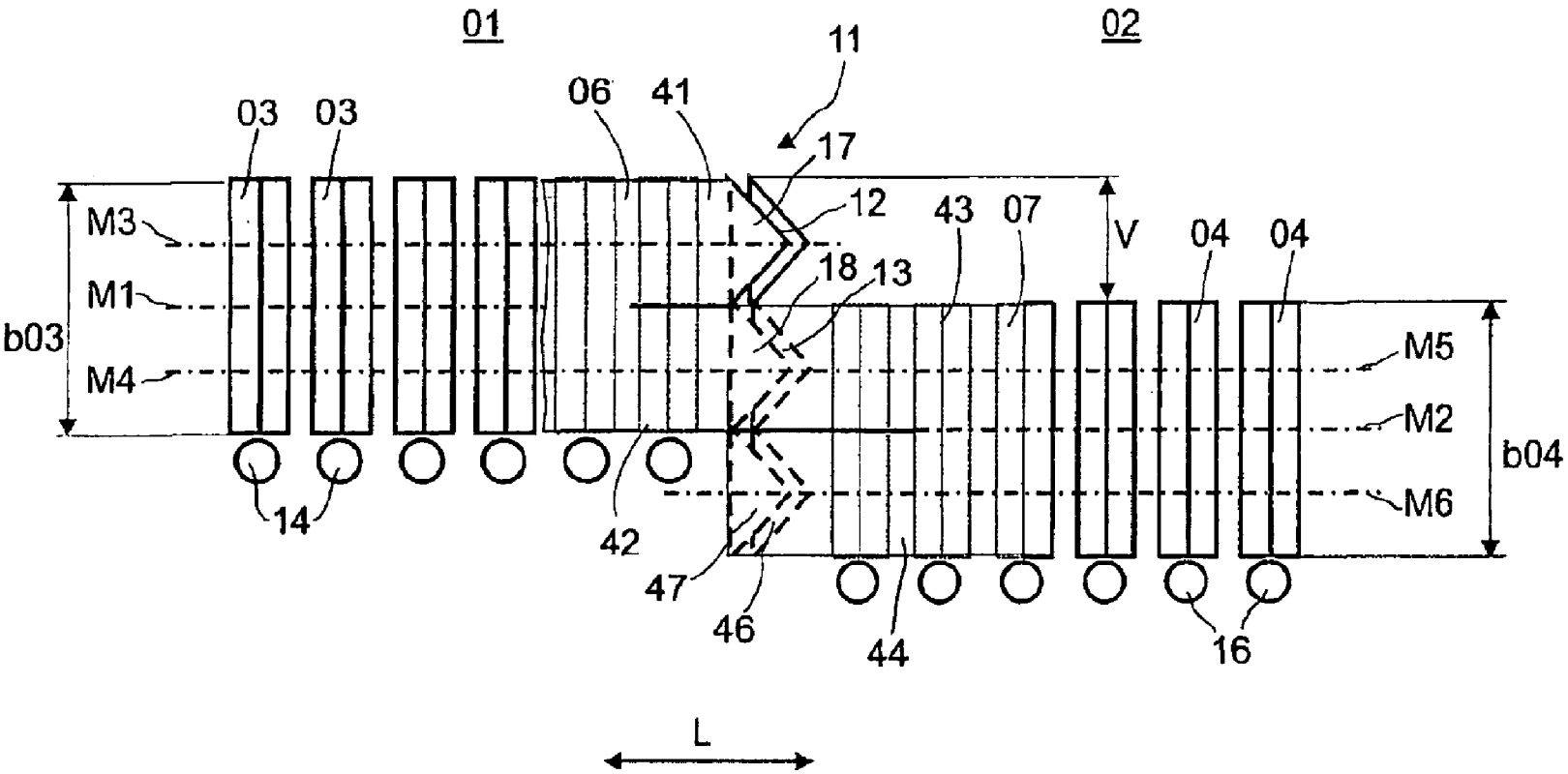

In a second preferred embodiment of the present invention, as seen in FIG. 5, the printing units 03, 04 of the sections 01, 02, or their printing groups, are embodied with printing group cylinders of double width, i.e. of four printed image widths, for example newspaper pages A, B, in the longitudinal direction of the printing group cylinder. The effective width b03, b04 therefore corresponds to at least four printed pages, or to at least four individual printing plates, placed side-by-side, or to two panorama printing plates, again placed side-by-side.

The two sections 01, 02 are offset, in respect to the planes of their center vertical lines M1, M2, and are arranged, in respect to a longitudinal direction L of the printing press, downstream or upstream of the folding structure 11, which is assigned to both sections 01, 02.

If the webs 06, 07, which in this second preferred embodiment are of double widths, are longitudinally cut by devices, which are not specifically represented, prior to their entry into the folding structure 11, such as is required, for example, for the production of newspapers, the planes of the central vertical lines M3, M4, M5, M6 of webs 41, 42, 43, 44, which are so-called partial webs 41, 42, 43, 44, or partial web strands formed from them, are of importance for as straight as possible an entry into the folding structure 11. For greater clarity only one double-width web 06, 07 is represented for each section 01, 02, which double-width web 06, 07 is cut into two partial webs 41, 42; 43, 44, respectively by the use of cutting devices, which are not specifically represented.

The lateral offset V of the two press sections 01, 02 of FIG. 5 approximately corresponds to a width of one of the partial webs 42, 43, or to double the width of the finished product folded once longitudinally. In case of sections 01, 02, or webs 06, 07, of equal width, and with the longitudinal cutting of each web 06, 07 into two partial webs 41, 42, 43, 44 of equal width, the offset V corresponds to half the width b06, bo7 of the original web 06, 07. Therefore the plane M4 coincides with the plane M5.

The common folding structure 11 is arranged between the sections 01, 02 and has at least three formers 12, 13, 46 arranged side-by-side, as seen in FIG. 5. The folding structure 11 preferably has three further formers 17, 18, 47, for example in the form of balloon formers 17, 18, 47, which are also arranged side-by-side, but which are situated above the first formers 12, 13, 46, in a manner similar to that depicted in FIGS. 3 and 4. The formers 12, 13, 17, 18, 46, 47 are arranged aligned in respect to the planes M3, M4 which coincides with M5, and M6. This allows a straight entry of the partial web strands 41, 42, 43, 44 into the folding structure 11.

The arrangement provides the productivity of a printing press of double width with two sections 01, 02 arranged aligned with each other, and allows a product variety which, in the case of printing presses of double width arranged aligned, is achieved with a three-story folding structure and appropriate turning deck, or by the lateral offset and removal of all partial webs for a fifth, and possibly a sixth strand. The product variety corresponds approximately to that of a triple-width printing press with a triple-width folding structure.

As in the first preferred embodiment, which is shown in FIG. 1, the press sections 01, 02 can each have a turning deck 36, 37, which is not specifically represented, in order to match the thickness of the individual partial strands 41, 42, 43, 44 to the requirements of the books to be produced. For example, for obtaining six identical book thicknesses when using six formers 12, 13, 17, 18, 46, 47, it is necessary, for example, to turn or to offset only two partial webs 42, 43, or only an uncut web 06, 07, onto an outer partial web 41, 44, or an outer web 06, 07, per section 01, 02.

As was the case in the first preferred embodiment depicted in FIG. 1, the webs 06, 07 are supplied from rolls 14, 16 to the press sections 01, 02, and are conducted to the formers 12, 13, 17, 18, 46, 47 upstream of the folding structure 11 by wire-rod rollers, which are not specifically represented. Product delivery can take place on one, on two, on three, or on up to six of the non-represented formers 12, 13, 17, 18, 46, 47 having a corresponding number of also non-represented delivery devices. In this second embodiment, the options of production should then be applied in accordance with the principle described in the first preferred embodiment.

For an even greater number of producible books, or greater product thicknesses, or greater variability, it is also possible to arrange the two sections 01, 02 from FIG. 5 completely offset in respect to each other in an arrangement corresponding to that depicted in FIG. 1. In this case, a folding structure 11 is embodied with four formers, such as formers 12, 13, 46 arranged side-by-side. In an advantageous embodiment, an additional four further formers, such as formers 17, 18, 46 are again arranged on top. The folding structure 11 then extends over the effective total width G.

It is possible, with this arrangement, to simultaneously produce up to eight books in printing units 03, 04, using cylinders of single circumference, and to produce, in printing units 03, 04 using cylinders of double width and in collection production up to sixteen different books.

While preferred embodiments of a printing machine with several sections, in accordance with the present invention, have been set forth fully and completely hereinabove, it will be apparent to one of skill in the art that various changes in, for example, the types of printing presses used, the types of roll supports and feeders being used and the like could be made without departing from the true spirit and scope of the present invention, which is accordingly to be limited only by the following claims.

What is claimed is:

1. A printing press comprising:

at least first and second press sections having a total section width;

at least a first printing unit in each of said at least first and second press sections, said at least first printing unit including printing unit cylinders adapted to print on at least one web passing through said at least first printing unit;

a common folding structure assigned to said at least first and second press sections and adapted to at least partially receive printed webs from both of said at least first and second press sections;

a printing press longitudinal direction, said at least first and second press sections at least partially directing printed webs to said common folding structure being offset to each other transversely to said printing press longitudinal direction; and a common folding structure width corresponding to said total section width of said at least first and second press sections arranged offset to each other transversely to said longitudinal direction.

2. The printing press of claim 1 wherein said at least first and second press sections are arranged offset to each other in said longitudinal direction.

3. The printing press of claim 1 wherein said at least first and second press sections are arranged next to each other.

4. The printing press of claim 1 wherein said offset transverse to said longitudinal direction corresponds to at least twice a width of a once longitudinally folded product of said printing press.

5. The printing press of claim 1 wherein said offset transverse to said longitudinal direction corresponds to at least a width of a printed page in an axial direction of said printing unit cylinders.

6. The printing press of claim 1 wherein said at least first printing unit in each of said at least first and second press sections is a single length printing unit adapted to print two printed pages arranged side by side in an axial direction of said printing unit cylinders.

7. The printing press of claim 6 wherein said common folding structure is a double wide folding structure adapted to process four printed pages arranged axially side by side.

8. The printing press of claim 7 further including first and second formers in said common folding structure, said first and second formers being arranged side by side transversely in respect to said printing press longitudinal direction.

9. The printing press of claim 7 wherein said common folding structure has first and second formers arranged side by side transversely in respect to said printing press longitudinal direction and further including third and fourth formers arranged above said first and second formers.

10. The printing press of claim 8 wherein each said former is arranged aligned with respect to a plane of a vertical center line of said at least first printing unit in each of said at least first and second press sections.

11. The printing press of claim 9 wherein each said former is arranged aligned with respect to a plane of a vertical center line of said at least first printing unit in each of said at least first and second press sections.

12. The printing press of claim 7 further including a first folding apparatus assigned to said common folding structure.

13. The printing press of claim 7 further including first and second folding apparatuses assigned to said common folding structure.

14. The printing press of claim 12 further including at least a first delivery device assigned to said first folding apparatus.

15. The printing press of claim 13 further including a first delivery device assigned to said first folding apparatus and a second delivery device assigned to said second folding apparatus.

16. The printing press of claim 2 wherein said common folding structure is arranged between said at least first and second press section in said printing press longitudinal direction.

17. The printing press of claim 1 wherein said at least first printing unit is a double wide printing unit adapted to print four pages arranged side by side in an axial direction of said printing unit cylinders.

18. The printing unit of claim 17 wherein said common folding structure is a triple wide folding structure adapted to process six printed pages arranged side by side in said axial direction.

19. The printing press of claim 17 wherein said common folding structure includes three formers arranged side by side transversely to said printing press longitudinal direction.

20. The printing press of claim 17 wherein said common folding structure includes first, second and third formers arranged side by side transversely to said printing press longitudinal direction and fourth, fifth and sixth formers arranged above said first, second, and third formers.

21. The printing press of claim 1 further including a turning deck assigned to at least one of said first and second press sections, said turning deck extending over said total section width.

22. A printing press comprising:

at least first and second press sections having a total section width;

at least a first printing unit in each of said at least first and second press sections, said at least first printing unit including printing unit cylinders adapted to print on at least on web passing through said at least first printing unit;

a common folding structure assigned to said at least first and second press sections and adapted to at least partially receive printed webs from both of said at least first and second press sections; and a printing press longitudinal direction, said at least first and second press sections at least partially directing printed webs to said common folding structure being offset to each other transversely to said printing press longitudinal direction, said common folding structure being arranged between said at least first and second press sections in said printing press longitudinal direction.

23. The printing press of claim 22 wherein said common folding structure has a folding structure width corresponding to said total section width of said at least first and second press sections arranged offset to each other transversely to said longitudinal direction.

24. The printing press of claim 22 wherein said offset transverse to said longitudinal direction corresponds to at least twice a width of a once longitudinally folded product of said printing press.

25. The printing press of claim 22 wherein said offset transverse to said longitudinal direction corresponds to at least a width of a printed page in an axial direction of said printing unit cylinders.

26. The printing press of claim 22 wherein said at least first printing unit in each of said at least first and second press sections is a single length printing unit adapted to print two printed pages arranged side by side in an axial direction of said printing unit cylinders.

27. The printing press of claim 26 wherein said common folding structure is a double wide folding structure adapted to process four printed pages arranged axially side by side.

28. The printing press of claim 27 further including first and second formers in said common folding structure, said first and second formers being arranged side by side transversely in respect to said printing press longitudinal direction.

29. The printing press of claim 27 wherein said common folding structure has first and second formers arranged side by side transversely in respect to said printing press longitudinal direction and further including third and fourth formers arranged above said first and second formers.

30. The printing press of claim 28 wherein each said former is arranged aligned with respect to a plane of a vertical center line of said at least first printing unit in each of said at least first and second press sections.

31. The printing press of claim 29 wherein each said former is arranged aligned with respect to a plane of a vertical center line of said at least first printing unit in each of said at least first and second press sections.

32. The printing press of claim 27 further including a first folding apparatus assigned to said common folding structure.

33. The printing press of claim 27 further including first and second folding apparatuses assigned to said common folding structure.

34. The printing press of claim 32 further including at least a first delivery device assigned to said first folding apparatus.

35. The printing press of claim 33 further including a first delivery device assigned to said first folding apparatus and a second delivery device assigned to said second folding apparatus.

36. The printing press of claim 22 wherein said at least first printing unit is a double wide printing unit adapted to print four pages arranged side by side in an axial direction of said printing unit cylinders.

37. The printing unit of claim 36 wherein said common folding structure is a triple wide folding structure adapted to process six printed pages arranged side by side in said axial direction.

38. The printing press of claim 36 wherein said common folding structure includes three formers arranged side by side transversely to said printing press longitudinal direction.

39. The printing press of claim 36 wherein said common folding structure includes first, second and third formers arranged side by side transversely to said printing press longitudinal direction and fourth, fifth and sixth formers arranged above said first, second, and third formers.

40. The printing press of claim 22 further including a turning deck assigned to at least one of said first and second press sections, said turning deck extending over said total section width.

* * * * *

UNITED STATES PATENT AND TRADEMARK OFFICE

CERTIFICATE OF CORRECTION

PATENT NO. : 6,886,823 B2 
DATED : May 3, 2005
INVENTOR(S) : Burkard Otto Herbert and Edgar Mayländer It is certified that error appears in the above-identified patent and that said Letters Patent is hereby corrected as shown below:

Title page,
Item [75], Inventors, add -- Edgar Mayländer, Estenfeld (DE) --

Signed and Sealed this

Nineteenth Day of July, 2005

JON W. DUDAS
*Director of the United States Patent and Trademark Office*